US010692343B2

(12) United States Patent
Sadek

(10) Patent No.: US 10,692,343 B2
(45) Date of Patent: Jun. 23, 2020

(54) SMART ENTRY POINT SPATIAL SECURITY SYSTEM

(71) Applicant: Kerloss Sadek, Lake Forest, CA (US)

(72) Inventor: Kerloss Sadek, Lake Forest, CA (US)

(73) Assignee: Hampton Products International Corporation, Foothill Ranch, CA (US)

( * ) Notice: Subject to any disclaimer, the term of this patent is extended or adjusted under 35 U.S.C. 154(b) by 0 days.

(21) Appl. No.: 16/232,919

(22) Filed: Dec. 26, 2018

(65) Prior Publication Data

US 2019/0197852 A1 Jun. 27, 2019

Related U.S. Application Data

(60) Provisional application No. 62/610,522, filed on Dec. 27, 2017.

(51) Int. Cl.
*G08B 13/00* (2006.01)
*G08B 13/22* (2006.01)
(Continued)

(52) U.S. Cl.
CPC ..... *G08B 13/22* (2013.01); *G07C 9/00* (2013.01); *G08B 13/08* (2013.01)

(58) Field of Classification Search
CPC ..... H04L 67/12; H04L 63/105; H04L 67/125; H04L 67/025; H04L 67/34; H04L 41/0803; H04L 61/1511; H04L 67/10; H04L 12/6418; H04L 47/125; H04L 61/301; H04L 61/305; H04L 63/0281; H04L 63/0823; H04L 12/282; H04L 12/4625; H04L 61/1564; H04L 61/6004; H04L 63/0861; H04L 63/168; H04L 67/1004; H04L 67/141; H04L 29/12; H04L 41/08; H04L 41/28; H04L 61/3045; H04L 61/6063; H04L 67/38; H04L 12/2809; H04L 12/283; H04L 2012/285; H04L 29/06; H04L 41/0806; H04L 41/0879; H04L 61/2514; H04L 61/2575; H04L 61/2589; H04L 63/0428; H04L 63/0442; H04L 63/08; H04L 67/04; H04L 67/26;
(Continued)

(56) References Cited

U.S. PATENT DOCUMENTS 9,460,596 B1 * 10/2016 Moses ..... H04N 7/14
10,037,689 B2 * 7/2018 Taylor ..... G08G 1/096775
(Continued)

*Primary Examiner* — Daniel Previl
(74) *Attorney, Agent, or Firm* — Klein, O'Neill & Singh, LLP

(57) ABSTRACT

A smart entry point spatial security system is intended for securing facility and other entrances in general. The system includes a device associated to an entry point. The device can be coupled externally to the entry point or natively as built-in to the entry point structure or any entry point subcomponents, such as knobs and locks. A host device with a software application monitors or observes the entry point sensor data via wired or wireless link such as Bluetooth. The sensor includes a software algorithm that is adapted to trigger safety alarms upon unauthorized usage of the entry point or as means of regulating entrance of users to a dedicated general space. The sensor data is stored locally on a host computer and a logging system is available on cloud computing device. The stored data will be used in further optimizing spatial data.

19 Claims, 10 Drawing Sheets

(51) Int. Cl.
*G07C 9/00* (2020.01)
*G08B 13/08* (2006.01)

(58) Field of Classification Search
CPC ..... H04L 67/2833; Y04S 40/18; B60K 31/00; B60K 31/18; B60Y 2200/11; B60Y 2200/12; B60Y 2200/126; B60Y 2200/13; B60Y 2200/30; B60Y 2200/40; B60Y 2200/50; B60Y 2200/90; G01C 21/00; G06Q 2240/00; G06Q 10/10; G06Q 10/103; G06Q 40/08; G06Q 10/08; G06Q 10/0832; G06Q 10/087; G07C 5/008; G07C 9/00; G07C 9/00134; G08G 1/00; G10L 15/22; G10L 15/1822; G10L 15/30; G10L 2015/223; G10L 2021/02082; G10L 21/0232; G10L 25/84; H04R 1/02; H04R 1/026; H04R 1/028; H04R 1/08; H04R 1/2803; H04R 1/323; H04R 1/403; H04R 2201/028; H04R 2227/003; H04R 2420/07; H04R 2420/09; H04R 2499/15; H04R 27/00; H04R 3/04; H04R 1/24; H04R 2227/005; H04W 4/70; H04W 12/02; H04W 4/80; H04W 12/06; H04W 40/22; H04W 4/02; H04W 4/38; H04W 4/90; H04W 84/18; H04W 12/0023; H04W 12/003; H04W 4/50; H04W 88/02; H04W 4/021; G08B 13/1966; G08B 13/19684; G08B 13/19697; G08B 21/0453; G08B 25/008; G08B 25/10; G08B 25/14; G08B 13/1672; G08B 19/005; G08B 25/08; G08B 13/08; G08B 13/22; G08B 25/009; H04N 7/185; H04N 7/147; H04N 5/2253; H04N 7/18; H04N 7/14; G05B 15/02; G16H 40/67; G16H 30/20; G16H 40/63; G16H 50/20; G16H 20/30; G16H 50/30; G16H 50/50; G16H 50/70; H01L 29/12; Y02D 70/00; Y02D 70/142; Y02D 70/144; Y02D 70/162; Y02D 70/166; Y02D 70/26; Y02D 70/164; Y02D 70/22; Y02D 70/39; Y02D 70/122; Y02D 70/124; Y02D 70/1262; Y02D 70/42; A61B 5/11; A61B 5/6804; A61B 2503/10; A61B 2562/0219; A61B 5/0022; A61B 5/01; A61B 5/024; A61B 5/0402; A61B 5/053; A61B 5/0533; A61B 5/055; A61B 5/4872; A61B 5/6806; A61B 5/6895; A61B 5/1116; A61B 5/1118; A61B 5/112; A63B 2071/1233; A63B 2071/125; A63B 2071/1283; A63B 21/072; A63B 21/0724; A63B 21/0726; A63B 2207/02; A63B 2220/12; A63B 2220/13; A63B 2220/16; A63B 2220/20; A63B 2220/24; A63B 2220/30; A63B 2220/40; A63B 2220/51; A63B 2220/53; A63B 2220/56; A63B 2220/72; A63B 2220/74; A63B 2220/75; A63B 2220/76; A63B 2220/803; A63B 2220/806; A63B 2220/807; A63B 2220/833; A63B 2220/836; A63B 2225/30; A63B 2225/50; A63B 2225/54; A63B 2230/06; A63B 2230/60; A63B 2230/70; A63B 2243/0025; A63B 2243/0037; A63B 2243/0054; A63B 2243/0066; A63B 2243/007; A63B 2243/0095; A63B 2244/102; A63B 2244/18; A63B 2244/19; A63B 2244/20; A63B 2244/203; A63B 69/0002; A63B 69/0026; A63B 69/0028; A63B 69/0048; A63B 69/0071; A63B 69/02; A63B 69/06; A63B 69/16; A63B 69/36; A63B 69/3632; A63B 71/085; A63B 71/10; A63B 71/1216; A63B 71/1291; A63B 71/141; A63B 71/145; A63B 2208/0204; A63B 2230/04; A63B 2230/50; A63B 24/0006; A63B 24/0021; A63B 24/0062; A63B 24/0075; A63B 43/004; A63B 60/46; A63B 69/38; A63B 71/06; B33Y 10/00; G01L 5/0052; G06F 1/163; G06F 3/00; G06F 3/017; G06F 9/4411; G06F 16/9566; G06F 8/60; G06F 9/4413; G06F 16/95; G06F 21/32; G06F 2221/2113; G06F 3/0346; G06F 3/0482; G06F 3/167; G06F 9/448; G06F 9/45504; G06K 9/00342; G06K 19/025; G06K 19/07762; G06K 9/00355; G06K 9/00671; G06K 9/00496; G09B 19/0038; G09B 19/003; H04H 20/59; H04Q 2209/40; H04Q 9/00
USPC ..... 340/541, 539.11, 539.1, 539.14, 539.17, 340/539.22, 545.6–545.9, 568.8, 570, 340/572.9, 691.6
See application file for complete search history.

(56) References Cited

U.S. PATENT DOCUMENTS

| | | | | |
|---|---|---|---|---|
| 10,361,802 | B1 * | 7/2019 | Hoffberg-Borghesani | H04N 5/782 |
| 2011/0156896 | A1 * | 6/2011 | Hoffberg | G05B 15/02 340/506 |
| 2013/0201316 | A1 * | 8/2013 | Binder | H04L 67/12 348/77 |
| 2013/0257611 | A1 * | 10/2013 | Lamb | G08B 13/02 340/501 |
| 2015/0237424 | A1 * | 8/2015 | Wilker | H04R 1/026 381/150 |
| 2019/0158353 | A1 * | 5/2019 | Johnson | G06F 9/4413 |

* cited by examiner

SMART ENTRY POINT SPATIAL SECURITY SYSTEM

CROSS-REFERENCE TO RELATED APPLICATION

This application claims the benefit of U.S. Provisional Application No. 62/610,522, filed Dec. 27, 2017, and entitled Smart Entry Point Spatial Security System; the entire disclosure of which is hereby incorporated by reference.

BACKGROUND OF THE INVENTION

1. Field of the Invention

The present invention relates to security systems. More particularly, some implementations of the described systems and methods relate to a smart entry point spatial security system adapted to provide security detection to a wide variety of entry points and enclosures.

2. Background and Related Art

An important part of any security system and technique is properly securing the entry points of a protected location, space, or volume. To this end, entry points are traditionally secured with a wide variety of locks and other security devices. Additionally, a variety of security sensors have been used to secure entry points. Many traditional entry point sensors utilize electromechanical structures that require significant modification to the overall structure (e.g., the frame, etc.) of the entry point. Alternative traditional entry point sensors rely on a magnetic sensor and a magnet, with one mounted on the barrier structure (e.g., door) and the other mounted on the frame such that if the entry point barrier structure is moved (e.g., opened), the magnet is separated from the sensor and an electric alarm can be activated. Accordingly, some traditional systems have been limited in that they require significant modification of the entry point or require multiple elements to be mounted to the fixed and moveable structures of the entry point.

Portable communication systems and devices have been integrated into many facets of daily life and are now commonly used by persons or users throughout their home environment and other locales. These devices include cellular telephones, smart phones, and portable digital assistants including laptops and tablet computers, as well as messaging devices, which are commonly used in association with specific applications. Such devices are generally connected to a mobile communication network, through which the devices receive and send notifications by using preinstalled application or software in the systems. When a notification is received, the devices provide audio, for example, ringtones or chimes, or motion feedback such as vibration to notify the user.

BRIEF SUMMARY OF THE INVENTION

Some implementations of the described invention provide systems and methods for providing security of entry point and detection of spatial movement of entry point barrier or blocking structures, such as hinged, sliding, and/or otherwise movable doors in doorways, windows in window frames, cabinet doors, drawers, lids, and/or any other blocking structure that selectively blocks or provides access to a location, volume, space, interior, and the like. Systems in accordance with some implementations of the invention utilize a standalone spatial sensor at one or more entry points to determine entry point status, and can be used for a variety of security applications, including home and commercial security, wireless security, and portable security, as well as for building automation and any other purpose where knowledge of entry point status is useful. In accordance with some implementations, the user of the system is enabled to predefine motion limits of an entry point apparatus, whereupon notifications may be provided when motion limits are exceeded.

An entry point sensor in accordance with some implementations of the invention is triggered upon entry point utilization. A device is installed on or otherwise incorporated with a rotating, sliding, and/or otherwise movable entry point structure (e.g., a blocking structure or barrier structure that limits use or passage of the entry point when in a closed position). In some cases, the device includes or houses a means or mechanism of monitoring changes in motion in multiple spatial axes. In some implementations, the device accounts for changes in the magnetic field (e.g. of the earth) as the device is moved. When motion is detected, such as limit-exceeding motion, the device communicates to a host device. Entry point status updates are logged to a cloud-based server in some implementations.

According to certain implementations of the described invention, an entry point security system includes one or more multi-axis position sensor apparatus and one or more monitoring devices. In this regard, the multi-axis position sensor apparatus of certain implementations includes: a sensor body adapted to be affixed to an entry point blocking structure, one or more sensor power supplies contained within (and/or otherwise associated with) the sensor body, one or more multi-axis motion detectors (and/or other suitable sensors) contained within (and/or otherwise associated with) the sensor body and operatively connected to the sensor power supply or supplies, one or more sensor communications interfaces operatively connected to the sensor power supply or supplies and contained within (or is otherwise associated with) the sensor body, and one or more sensor processors operatively connected to the motion detector (or detectors), the sensor communications interface (or interfaces), and/or the sensor power supply (or supplies) and is contained within (and/or otherwise associated with) the sensor body, the processor being configured to detect motions of the sensor body from input received from the motion detector (or detectors) and to transmit information regarding the motions of the sensor body using the sensor communications interface (or interfaces).

In accordance with at least some implementations, the monitoring device is at least intermittently communicatively coupled to the multi-axis position sensor apparatus and includes: one or more monitor power supplies, monitor communications interfaces operatively connected to the monitor power supply (or supplies), and at least intermittently communicatively coupled with the sensor communications interface (or interfaces), and one or more monitor processors operatively connected to the monitor power supply (or supplies) and the monitor communications interface (or interfaces) and adapted to receive and process the information regarding the motions of the sensor body to generate notifications of entry status changes.

In some implementations, the sensor power supply includes one or more batteries. In some implementations, at least one battery is removable. In some implementations, at least one battery is rechargeable. In other implementations, at least one battery is a single-use battery. In some implementations, the multi-axis position sensor apparatus is selectively removable from the entry point blocking structure and is capable of being docked in a recharging station. In some implementations, the sensor power supply includes a wired connection to a power source. In some implementations the sensor power supply receives power wirelessly (e.g., via inductive power transmission and/or in any other suitable manner).

In some implementations, the monitor power supply includes one or more batteries. In some implementations, at least one battery is removable. In some implementations, at least one battery is rechargeable. In other implementations, at least one battery is a single-use battery. In some implementations, the monitoring device is configured to be docked in a charger to charge the battery. In some implementations, the monitor power supply includes a wired connection to a power source.

In some implementations, the entry point blocking structure is a structure such as a hinged door, a sliding door, a window, a drawer, a lid, and/or any other structure that is configured to be opened and closed. In some implementations, the monitoring device comprises a device such as a dedicated entry point security hub, a desktop computing device, a laptop computing device, a tablet computing device, a smart phone, and/or any other suitable device that is configured to communicate with the sensor apparatus.

In some implementations, the system includes a plurality of the multi-axis position sensor apparatuses, each sensor apparatus at least intermittently communicatively coupled to the monitoring device and each adapted to be affixed to a different entry point blocking structure. In some implementations, at least one of the plurality of multi-axis position sensor apparatuses receives transmissions of information regarding motions of the body of another of the plurality of multi-axis position sensors and retransmits the information to the monitoring device.

In various implementations, the multi-axis motion detector comprises one or more of a variety of sensors, such as a three-axis sensor (including a three-axis accelerometer), a three-axis sensor (including a three-axis compass), a three-axis sensor (including a three-axis gyroscope), a six-axis sensor (including a three axis gyroscope and a three axis compass), a six-axis sensor (including a three-axis accelerometer and a three-axis gyroscope), a six-axis sensor (including a three-axis accelerometer and a three-axis compass), a nine-axis sensor (including a three-axis accelerometer, a three-axis gyroscope, and a three-axis compass), and/or any other suitable sensors. In some implementations, the multi-axis motion detector includes an electromechanical motion sensor.

In some implementations, the sensor communications interface and the monitor communications interface each comprises an interface such as a wired interface, a Bluetooth wireless interface, an IEEE 802.11 (Wi-Fi) wireless interface, a wireless mesh network interface, a cellular network interface, and/or any other suitable communications interface. In some implementations, the monitoring device is configured to convey the notifications of entry status changes to a user of the entry point security system through an action such as displaying visual notifications on a screen of the monitoring device, playing audio notifications on a sound transducer of the monitoring device, generating vibratory notifications of a vibrator of the monitoring device, generating and transmitting notifications through a computer network to a remote computing device, modifying a state of an external device capable of generating an audio or visual cue, in any other suitable manner, or any combination of the foregoing.

In some implementations, the information regarding the motions of the sensor body includes information such as transient accelerometer readings, transient gyroscope readings, transient compass readings, changed but non-transient compass readings, any other suitable readings, or any combination of the foregoing.

The sensor body can be coupled to an entry point blocking structure (and/or to any other suitable portion of the blocking structure that is configured to move) in any suitable manner. Indeed, in some implementations, the sensor body is affixed to the entry point blocking structure by an adhesive material disposed between the sensor body and the entry point blocking structure. In other implementations, the sensor body is affixed to the entry point blocking structure by a one or more suction cups. In other implementations, the sensor body is affixed to the entry point blocking structure by a fastener extending between the sensor body and the entry point blocking structure. In further implementations, the sensor body is affixed to the entry point blocking structure by a body mating structure incorporated into the sensor body and adapted to mate to an entry point mating structure incorporated into the entry point blocking structure. In still other implementations, the sensor body is affixed to the entry point blocking structure by incorporation of the sensor body into a locking structure of the entry point blocking structure. In other implementations, the sensor body is affixed to the entry point blocking structure by incorporation of the sensor body into an operating structure of the entry point blocking structure. In other implementations, the sensor body is affixed to the entry point blocking structure by incorporation of at least a portion of the sensor body into the entry point blocking structure.

In some implementations, the system further comprises one or more non-volatile memory stores. In this regard, some implementations of the system are configured to include a programming function wherein programming information from the multi-axis motion detector is obtained while the entry point blocking structure is in a plurality of positions, including at least a closed position and an open position. The programming information is stored (in some cases) on the non-volatile memory store with information identifying corresponding positions of the entry point blocking structure. The system is configured to compare the information regarding the motions of the sensor body with the programming information to determine a state of the entry point blocking structure.

In some implementations, the non-volatile memory store includes a memory store of a device such as the monitoring device or another local computing device at least intermittently communicatively coupled to the monitoring device, such as a dedicated security hub, a local server, a desktop computing device, a laptop computing device, a tablet computing device, a smart phone, and/or any other suitable device. In other implementations, the non-volatile memory store comprises a memory store of a remote computing device at least intermittently communicatively coupled to the monitoring device over a computer network such as a remote dedicated security device, a remote server, a remote desktop computing device, a remote laptop computing device, a remote tablet computing device, a remote smart phone, and/or any other suitable device. In still other implementations, the non-volatile memory store comprises a memory store incorporated into the multi-axis position sensor apparatus.

In some implementations, the sensor communications interface includes a wireless interface having a dynamic range control and/or dynamic impedance tuning adapted to minimize power usage while adapting for range changes between the multi-axis position sensor apparatus and the monitoring device.

According to certain implementations, a method for providing entry point security includes associating a multi-axis position sensor apparatus to an entry point blocking structure, the position sensor apparatus including a multi-axis motion detector, and communicatively coupling a monitoring device to the multi-axis position sensor apparatus. The method also includes detecting, at the multi-axis position sensor using the multi-axis motion detector, a movement of the entry point blocking structure, receiving, at the monitoring device, a transmission of information from the multi-axis position sensor indicative of the movement of the entry point blocking structure, processing the information from the multi-axis position sensor to determine a status of the entry point blocking structure, and/or generating a notification of the status of the entry point blocking structure.

In some implementations, the method further includes performing a setup procedure after the multi-axis position sensor apparatus is associated with the entry point blocking structure. The setup procedure includes positioning the entry point blocking structure at a plurality of positions including at least a fully closed position at which the entry point blocking structure prevents access to a location and an open position at which the entry point blocking structure permits at least some access to the location (or in which the entry point blocking structure is not completely closed). In accordance with some implementations, the setup procedure also includes at each of the plurality of positions, obtaining information regarding readings of the multi-axis motion detector from the multi-axis position sensor apparatus. The setup procedure also includes storing the information regarding readings of the multi-axis motion detector to a non-volatile memory store for use in determining entry point blocking structure position by comparison between the stored information and later-obtained information.

According to some implementations, the multi-axis motion detector used in the method includes a detector, such as a three-axis sensor including a three-axis accelerometer, a three-axis sensor including a three-axis compass, a three-axis sensor including a three-axis gyroscope, a six-axis sensor including a three axis gyroscope and a three axis compass, a six-axis sensor including a three-axis accelerometer and a three-axis gyroscope, a six-axis sensor including a three-axis accelerometer and a three-axis compass, a nine-axis sensor including a three-axis accelerometer, a three-axis gyroscope, and a three-axis compass, and/or any other suitable sensor. In some implementations of the method, transmission of information from the multi-axis position sensor is received via an interface, such as a wired interface, a Bluetooth wireless interface, an IEEE 802.11 (Wi-Fi) wireless interface, a wireless mesh network interface, a cellular network interface, and/or any other suitable interface.

In some implementations of the method, the notification of the status of the entry point blocking structure includes one of a visual notification on a screen of the monitoring device, an audio notification on a sound transducer of the monitoring device, a vibratory notification of a vibrator of the monitoring device, a notification transmitted through a computer network to a remote computing device, a modification of a state of a separate linked device capable of generating an audio or visual cue, any other suitable cue or communication, or any combination thereof. In some implementations of the method, the movement of the entry point blocking structure is detected by a measurement including a changed measurement of a compass of the multi-axis position sensor apparatus.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
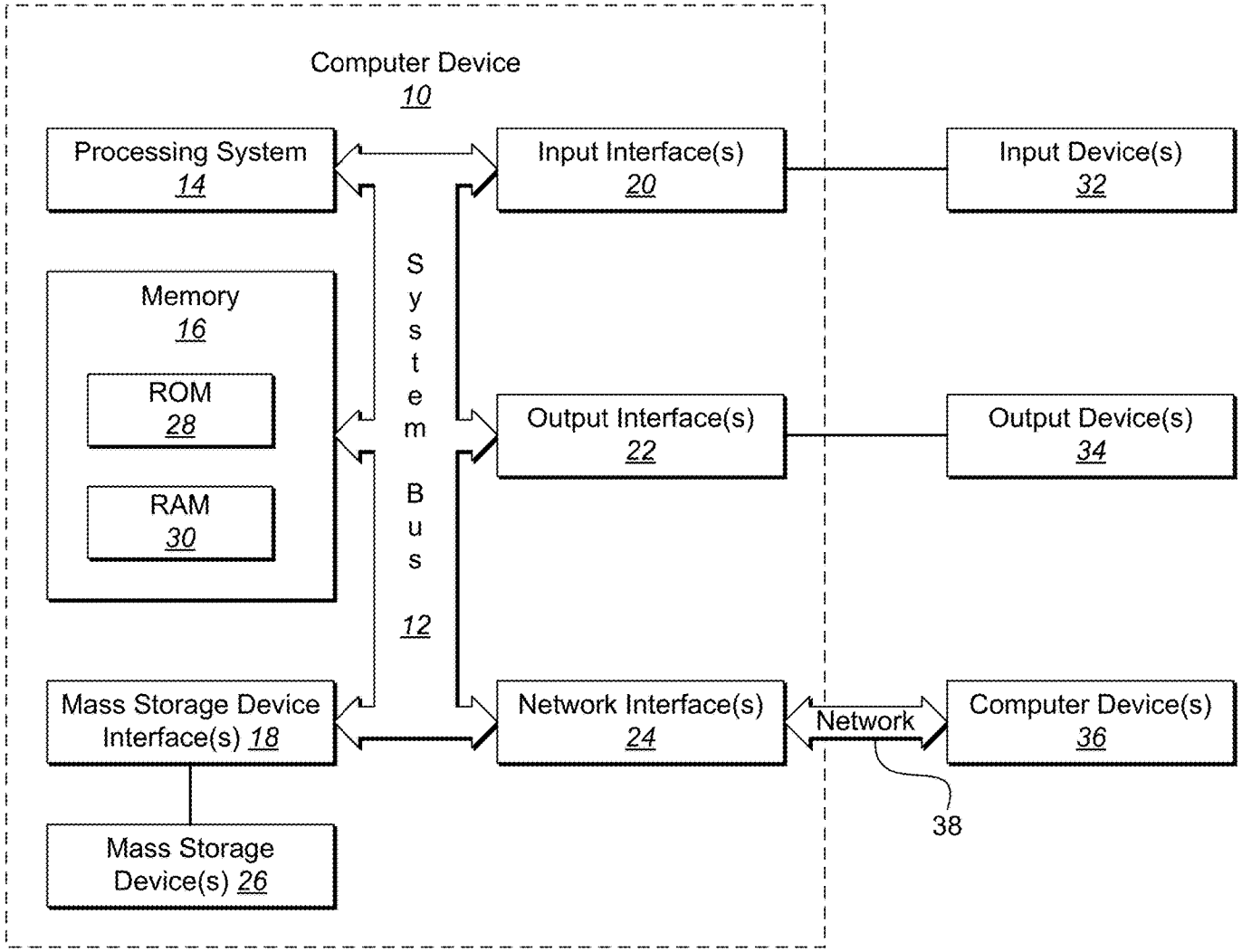
FIG. 1 shows a representative embodiment of a computing environment for use with some embodiments of the present invention.

A description of embodiments of the present invention will now be given with reference to the FIGS. It is expected that the present invention may take many other forms and shapes, hence the following disclosure is intended to be illustrative and not limiting, and the scope of the invention should be determined by reference to the appended claims.

According to certain embodiments of the invention, an entry point security system includes a multi-axis position sensor apparatus and a monitoring device. The multi-axis position sensor apparatus of certain embodiments includes: a sensor body adapted to be affixed to an entry point blocking structure, a sensor power supply contained within (and/or otherwise associated with) the sensor body, a multi-axis motion detector contained within (and/or otherwise associated with) the sensor body and operatively connected to the sensor power supply, a sensor communications interface operatively connected to the sensor power supply and contained within the sensor body, and/or a sensor processor operatively connected to the motion detector, the sensor communications interface, and/or the sensor power supply and contained within (or otherwise associated with) the sensor body, the processor being configured to detect motions of the sensor body from input received from the motion detector and to transmit information regarding the motions of the sensor body using the sensor communications interface. In accordance with some embodiments, the monitoring device is at least intermittently communicatively coupled to the multi-axis position sensor apparatus and includes a monitor power supply, a monitor communications interface operatively connected to the monitor power supply and at least intermittently communicatively coupled with the sensor communications interface, and/or a monitor processor operatively connected to the monitor power supply and the monitor communications interface and adapted to receive and process the information regarding the motions of the sensor body to generate notifications of entry status changes.

In some embodiments, the sensor power supply includes a battery. In some embodiments the battery is removable. In some embodiments, the battery is rechargeable. In other embodiments, the battery comprises a single-use battery. In some embodiments, the multi-axis position sensor apparatus is removable from the entry point blocking structure and is capable of being docked in (and/or otherwise coupled to) a recharging station. In some embodiments, the sensor power supply includes a wired connection to a power source. In some embodiments the sensor power supply receives power wirelessly (e.g., via inductive power transmission and/or in any other suitable manner).

In some embodiments, the monitor power supply includes a battery. In some embodiments the battery is removable. In some embodiments, the battery is rechargeable. In other embodiments, the battery is a single-use battery. In some embodiments, the monitoring device can be docked in a charger to charge the battery. In some embodiments, the monitor power supply includes a wired connection to a power source.

In some embodiments, the entry point blocking structure is a structure such as a hinged door, a sliding door, a window, a drawer, a lid, and/or any other suitable movable object. In some embodiments, the monitoring device comprises a device such as a dedicated entry point security hub, a desktop computing device, a laptop computing device, a tablet computing device, a smart phone, and/or any other suitable device.

In some embodiments, the system includes a plurality of the multi-axis position sensor apparatuses, each sensor apparatus at least intermittently communicatively coupled to the monitoring device and each adapted to be affixed to a different entry point blocking structure. In some embodiments, at least one of the plurality of multi-axis position sensor apparatuses receives transmissions of information regarding motions of the body of another of the plurality of multi-axis position sensors and retransmits the information to the monitoring device.

In various embodiments, the multi-axis motion detector comprises one or more of a variety of sensors, such as a three-axis sensor (including a three-axis accelerometer), a three-axis sensor (including a three-axis compass), a three-axis sensor (including a three-axis gyroscope), a six-axis sensor (including a three axis gyroscope and a three axis compass), a six-axis sensor (including a three-axis accelerometer and a three-axis gyroscope), a six-axis sensor (including a three-axis accelerometer and a three-axis compass), a nine-axis sensor (including a three-axis accelerometer, a three-axis gyroscope, and a three-axis compass), and/or any other suitable sensor. In some embodiments, the multi-axis motion detector includes an electromechanical motion sensor.

In some embodiments, the sensor communications interface and the monitor communications interface each comprise an interface, such as a wired interface, a Bluetooth wireless interface, an IEEE 802.11 (Wi-Fi) wireless interface, a wireless mesh network interface, a cellular network interface, and/or any other suitable communications interface. In some embodiments, the monitoring device is configured to convey the notifications of entry status changes to a user of the entry point security system through an action such as displaying visual notifications on a screen of the monitoring device, playing audio notifications on a sound transducer of the monitoring device, generating vibratory notifications of a vibrator of the monitoring device, generating and transmitting notifications through a computer network to a remote computing device, modifying a state of an external device capable of generating an audio or visual cue, providing any other notification, or any combination thereof.

In some embodiments, the information regarding the motions of the sensor body includes information such as transient accelerometer readings, transient gyroscope readings, transient compass readings, changed but non-transient compass readings, any other suitable readings, or any combination thereof.

The sensor body can be coupled to the entry point blocking structure in any suitable manner. In some embodiments, the sensor body is affixed to the entry point blocking structure by an adhesive material disposed between the sensor body and the entry point blocking structure. In other embodiments, the sensor body is affixed to the entry point blocking structure by a suction cup. In other embodiments, the sensor body is affixed to the entry point blocking structure by a fastener extending between the sensor body and the entry point blocking structure. In further embodiments, the sensor body is affixed to the entry point blocking structure by a body mating structure incorporated into the sensor body and adapted to mate to an entry point mating structure incorporated into the entry point blocking structure. In still other embodiments, the sensor body is affixed to the entry point blocking structure by incorporation of the sensor body into a locking structure of the entry point blocking structure. In other embodiments, the sensor body is affixed to the entry point blocking structure by incorporation of the sensor body into (or with) an operating structure of the entry point blocking structure. In other embodiments, the sensor body is affixed to the entry point blocking structure by incorporation of at least a portion of the sensor body into the entry point blocking structure.

In some embodiments, the system further comprises a non-volatile (and/or any other suitable) memory store. In some cases, the system is configured to include a programming function wherein programming information from the multi-axis motion detector is obtained while the entry point blocking structure is in a plurality of positions, including at least a first (e.g., closed) position and a second (e.g., open) position. The programming information is stored on the non-volatile memory store with information identifying corresponding positions of the entry point blocking structure. The system is configured to compare the information regarding the motions of the sensor body with the programming information to determine a state of the entry point blocking structure.

In some embodiments, the non-volatile memory store comprises a memory store of a device such as the monitoring device or another local computing device at least intermittently communicatively coupled to the monitoring device such as a dedicated security hub, a local server, a desktop computing device, a laptop computing device, a tablet computing device, a smart phone, and/or any other suitable device. In other embodiments, the non-volatile memory store comprises a memory store of a remote computing device at least intermittently communicatively coupled to the monitoring device over a computer network such as a remote dedicated security device, a remote server, a remote desktop computing device, a remote laptop computing device, a remote tablet computing device, a remote smart phone, and/or any other suitable device. In still other embodiments, the non-volatile memory store comprises a memory store incorporated into the multi-axis position sensor apparatus.

In some embodiments, the sensor communications interface includes a wireless interface having a dynamic range control and/or dynamic impedance tuning adapted to minimize power usage while adapting for range changes between the multi-axis position sensor apparatus and the monitoring device.

According to certain embodiments, a method for providing entry point security includes associating a multi-axis position sensor apparatus to an entry point blocking structure, the position sensor apparatus including a multi-axis motion detector, and/or communicatively coupling a monitoring device to the multi-axis position sensor apparatus. The method also includes detecting, at the multi-axis position sensor using the multi-axis motion detector, a movement of the entry point blocking structure, receiving, at the monitoring device, a transmission of information from the multi-axis position sensor indicative of the movement of the entry point blocking structure, processing the information from the multi-axis position sensor to determine a status of the entry point blocking structure, and/or generating a notification of the status of the entry point blocking structure.

In some embodiments, the method further includes performing a setup procedure after the multi-axis position sensor apparatus is associated with the entry point blocking structure. The setup procedure includes positioning the entry point blocking structure at a plurality of positions including at least first position (e.g., a fully closed position at which the entry point blocking structure prevents access to a location) and a second position (e.g., an open position at which the entry point blocking structure permits access to the location). The setup procedure also includes (in at least some embodiments) at each of the plurality of positions, obtaining information regarding readings of the multi-axis motion detector from the multi-axis position sensor apparatus. Some embodiments of the setup procedure also include storing the information regarding readings of the multi-axis motion detector to a non-volatile memory store for use in determining entry point blocking structure position by comparison between the stored information and later-obtained information.

According to some embodiments, the multi-axis motion detector used in the method includes a detector, such as a three-axis sensor (including a three-axis accelerometer), a three-axis sensor (including a three-axis compass), a three-axis sensor (including a three-axis gyroscope), a six-axis sensor (including a three axis gyroscope and a three axis compass), a six-axis sensor (including a three-axis accelerometer and a three-axis gyroscope), a six-axis sensor (including a three-axis accelerometer and a three-axis compass), a nine-axis sensor (including a three-axis accelerometer, a three-axis gyroscope, and a three-axis compass), and/or any other suitable sensor. In some embodiments of the method, transmission of information from the multi-axis position sensor is received via an interface such as a wired interface, a Bluetooth wireless interface, an IEEE 802.11 (Wi-Fi) wireless interface, a wireless mesh network interface, a cellular network interface, and/or any other suitable communications interface.

In some embodiments, the notification of the status of the entry point blocking structure includes one of a visual notification on a screen of the monitoring device, an audio notification on a sound transducer of the monitoring device, a vibratory notification of a vibrator of the monitoring device, a notification transmitted through a computer network to a remote computing device, a modification of a state of a separate linked device capable of generating an audio or visual cue, any other suitable indications, or any combination thereof. In some embodiments of the method, the movement of the entry point blocking structure is detected by a measurement including a changed measurement of a compass of the multi-axis position sensor apparatus.

As embodiments of the invention embrace the user of computer systems and computing devices in conjunction with the various embodiments of the special security systems, FIG. 1 and the corresponding discussion are intended to provide a general description of a suitable computer operating environment in which or with which embodiments of the invention may be implemented. One skilled in the art will appreciate that embodiments of the invention may be practiced by one or more computing devices and in a variety of system configurations, including in a networked configuration. However, while the methods and processes of the present invention have proven to be particularly useful in association with a system comprising a general purpose computer, embodiments of the present invention include utilization of the methods and processes in a variety of environments, including embedded systems with general purpose processing units, digital/media signal processors (DSP/MSP), application specific integrated circuits (ASIC), stand alone electronic devices, and other such electronic environments.

Embodiments of the present invention embrace one or more computer-readable media, wherein each medium may be configured to include or includes thereon data or computer executable instructions for manipulating data. The computer executable instructions include data structures, objects, programs, routines, or other program modules that may be accessed by a processing system, such as one associated with a general-purpose computer capable of performing various different functions or one associated with a special-purpose computer capable of performing a limited number of functions. Computer executable instructions cause the processing system to perform a particular function or group of functions and are examples of program code means for implementing steps for methods disclosed herein. Furthermore, a particular sequence of the executable instructions provides an example of corresponding acts that may be used to implement such steps. Examples of computer-readable media include random-access memory ("RAM"), read-only memory ("ROM"), programmable read-only memory ("PROM"), erasable programmable read-only memory ("EPROM"), electrically erasable programmable read-only memory ("EEPROM"), compact disk read-only memory ("CD-ROM"), or any other device or component that is capable of providing data or executable instructions that may be accessed by a processing system.

While embodiments of the invention embrace the use of all types of computer-readable media, certain embodiments as recited in the claims may be limited to the use of tangible, non-transitory computer-readable media, and the phrases "tangible computer-readable medium" and "non-transitory computer-readable medium" (or plural variations) used herein are intended to exclude transitory propagating signals per se.

With reference to FIG. 1, a representative system for implementing or for use with implementing embodiments of the invention includes computer device 10, which may be a general-purpose or special-purpose computer or any of a variety of consumer electronic devices. For example, computer device 10 may be a personal computer, a notebook or laptop computer, a netbook, a personal digital assistant ("PDA") or other hand-held device, a smart phone, a tablet computer, a workstation, a minicomputer, a mainframe, a supercomputer, a multi-processor system, a network computer, a processor-based consumer electronic device, a computer device integrated into another device or vehicle, or the like. In a typical use case, computer device 10 may be a mobile device such as a smart phone operating an application adapted to exchange information with an entry point sensor (e.g. through a wireless data connection, such as a Bluetooth connection and/or other suitable wireless communication method).

Computer device 10 includes system bus 12, which may be configured to connect various components thereof and enables data to be exchanged between two or more components. System bus 12 may include one of a variety of bus structures including a memory bus or memory controller, a peripheral bus, or a local bus that uses any of a variety of bus architectures. Typical components connected by system bus 12 include processing system 14 and memory 16. Other components may include one or more mass storage device interfaces 18, input interfaces 20, output interfaces 22, and/or network interfaces 24, each of which will be discussed below.

Processing system 14 includes one or more processors, such as a central processor and optionally one or more other processors designed to perform a particular function or task. It is typically processing system 14 that executes the instructions provided on computer-readable media, such as on memory 16, a solid-state storage device, a magnetic hard disk, a removable magnetic disk, a magnetic cassette, an optical disk, or from a communication connection, which may also be viewed as a computer-readable medium.

Memory 16 includes one or more computer-readable media that may be configured to include or includes thereon data or instructions for manipulating data, and may be accessed by processing system 14 through system bus 12. Memory 16 may include, for example, ROM 28, used to permanently store information, and/or RAM 30, used to temporarily store information. ROM 28 may include a basic input/output system ("BIOS") having one or more routines that are used to establish communication, such as during start-up of computer device 10. RAM 30 may include one or more program modules, such as one or more operating systems, application programs, and/or program data.

One or more mass storage device interfaces 18 may be used to connect one or more mass storage devices 26 to system bus 12. The mass storage devices 26 may be incorporated into or may be peripheral to computer device 10 and allow computer device 10 to retain large amounts of data. Optionally, one or more of the mass storage devices 26 may be removable from computer device 10. Examples of mass storage devices include solid state drives, hard disk drives, magnetic disk drives, tape drives and optical disk drives. A mass storage device 26 may read from and/or write to a magnetic hard disk, a removable magnetic disk, a magnetic cassette, an optical disk, or another computer-readable medium. Mass storage devices 26 and their corresponding computer-readable media provide non-volatile storage of data and/or executable instructions that may include one or more program modules such as an operating system, one or more application programs, other program modules, or program data. Such executable instructions are examples of program code means for implementing steps for methods disclosed herein.

One or more input interfaces 20 may be employed to enable a user to enter data and/or instructions to computer device 10 through one or more corresponding input devices 32. Examples of such input devices include a keyboard and alternate input devices, such as a touch screen, mouse, trackball, light pen, stylus, or other pointing device, a microphone, a joystick, a game pad, a satellite dish, a scanner, a camcorder, a digital camera, a sensor (e.g., a multi-axis spatial sensor), and the like. Similarly, examples of input interfaces 20 that may be used to connect the input devices 32 to the system bus 12 include a serial port, a parallel port, a game port, a universal serial bus ("USB"), an integrated circuit, a firewire (IEEE 1394), or another interface. For example, in some embodiments input interface 20 includes an application specific integrated circuit (ASIC) that is designed for a particular application. In a further embodiment, the ASIC is embedded and connects existing circuit building blocks.

One or more output interfaces 22 may be employed to connect one or more corresponding output devices 34 to system bus 12. Examples of output devices include a monitor or display screen, a speaker, a printer, a multi-functional peripheral, and the like. A particular output device 34 may be integrated with or peripheral to computer device 10. Examples of output interfaces include a video adapter, an audio adapter, a parallel port, and the like.

One or more network interfaces 24 enable computer device 10 to exchange information with one or more other local or remote computer devices, illustrated as computer devices 36, via a network 38 that may include hardwired and/or wireless links. Examples of network interfaces include a network adapter for connection to a local area network ("LAN") or a modem, wireless link, or other adapter for connection to a wide area network ("WAN"), such as the Internet. Other examples of network interfaces include wireless devices for communicating via near-field communication (NFC), Bluetooth, and the like. The network interface 24 or interfaces 24 may be incorporated with or peripheral to computer device 10. In a networked system, accessible program modules or portions thereof may be stored in a remote memory storage device. Furthermore, in a networked system computer device 10 may participate in a distributed computing environment, where functions or tasks are performed by a plurality of networked computer devices.

Figure 2:
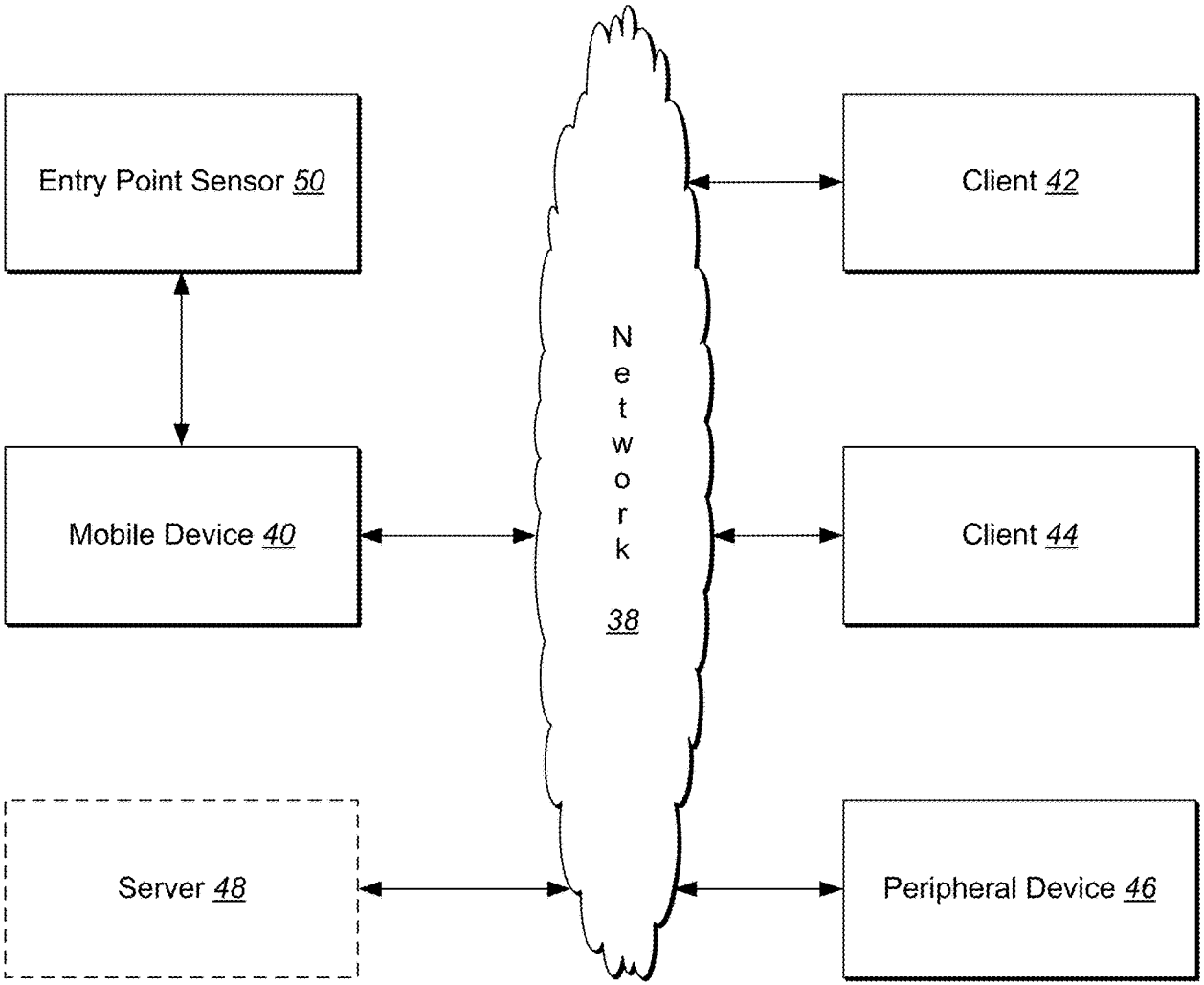
FIG. 2 shows a representative networked computing environment for use with some embodiments of the present invention.

Thus, while those skilled in the art will appreciate that embodiments of the present invention may be practiced in a variety of different environments with many types of system configurations, FIG. 2 provides a representative networked system configuration that may be used in association with embodiments of the present invention. The representative system of FIG. 2 includes a computer device, illustrated as mobile device 40, which is connected to one or more other computer devices (illustrated as client 42 and client 44) and one or more peripheral devices 46 across network 38. While FIG. 2 illustrates an embodiment that includes a mobile device 40, two additional clients, client 42 and client 44, one peripheral device 46, and optionally a server 48, connected to network 38, alternative embodiments include more or fewer clients, no clients, more than one peripheral device, no peripheral devices, no server 48, and/or more than one server 48 connected to network 38. Other embodiments of the present invention include local, networked, or peer-to-peer environments where one or more computer devices may be connected to one or more local or remote peripheral devices. Moreover, embodiments in accordance with the present invention also embrace a single electronic consumer device, wireless networked environments, and/or wide area networked environments, such as the Internet.

Similarly, embodiments of the invention embrace cloud-based architectures where one or more computer functions are performed by remote computer systems and devices at the request of a local computer device. Thus, returning to FIG. 2, the mobile device 40 may be a computer device having a limited set of hardware and/or software resources. Because the mobile device 40 is connected to the network 38, it may be able to access hardware and/or software resources provided across the network 38 by other computer devices and resources, such as client 42, client 44, server 48, or any other resources. The mobile device 40 may access these resources through an access program, and the results of any computer functions or resources may be delivered through the access program to the user of the mobile device 40. In such configurations, the mobile device 40 may be any type of computer device or electronic device discussed above or known to the world of cloud computing, including traditional desktop and laptop computers, smart phones and other smart devices, tablet computers, fixed or mobile dedicated security hubs, or any other device able to provide access to remote computing resources through an access program such as a browser.

The mobile device 40 of FIG. 2 is shown as being communicatively connected to an entry point sensor 50. The connection between the mobile device 40 and the entry point sensor 50 may be wired or wireless, and the communicative connection allows the mobile device 40 to perform computational functions or analysis using information received from the entry point sensor 50. Accordingly, because certain functions relating to spectrum analysis need not be contained within or performed by the entry point sensor 50 itself, the size and power requirements of the entry point sensor 50 can be minimized. Similarly, as discussed above, because the mobile device 40 may be connected through the network 38 to additional computational resources, the mobile device 40 need not contain all information and need not perform all computational functions necessary for performance of its security functions.

For example, the server 48 (or servers 48) may include one or more databases of known sensor responses related to the entry point sensor 50. The one or more databases could be maintained on a non-volatile memory store of the server 48. Then, when a multi-axis motion detector of the entry point sensor 50 detects a motion, the detected motion or information about the detected motion can be transmitted to the mobile device 40, such as using a Bluetooth connection, and the mobile device 40 can then transmit either the information about the detected motion, including potentially after some analysis performed by an application or app running on the mobile device 40 through the network 38 to the server 48 or servers 48.

The server 48 or servers 48 and/or systems associated with the server 48 or servers 48 can take the information received from the mobile device 40 and can relatively quickly perform a comparison with known motion information stored on the one or more databases to identify a matching status of the entry point (e.g., open, closed, partially open, opening, closing, etc.), and can send information and/or reports back to the mobile device 40 for display or other notification to the user. The server or servers 48 can also transmit notifications remotely depending on system settings then in effect, as will be discussed in more detail below.

According to some embodiments, the system includes a wireless alerting system for points of entry monitoring or supervision. The system includes a cloud service for storing of status updates, notifications, and/or media logged by an observing device (a host device or monitoring device) in at least intermittent communicative connection with a motion identifier device (a sensor device) located on a moveable entry point structure within a selected proximity of the observing device. The selected proximity may encompass a home or business or a portion thereof. The observing device provides infrastructure for the system, including a power supply and a user interface, and the identifier device is a stand-alone device for attachment to or incorporation into a moveable structure of an entry point such as a door, window, drawer, cabinet, lid, etc.

In accordance with certain embodiments of the system, the observing device is a Bluetooth-enabled device (e.g., Bluetooth version 4.0 or above and/or any other suitable version of Bluetooth), such as mobile devices like cellular phones, smart phones, laptops, tablet computers, and the like. In accordance with other embodiments, the observing device is a dedicated device with functionality primarily focused on providing the security features discussed herein. Regardless, the user interface of the observing device of some embodiments includes one or more of a visual monitor or display, an audible signal, or a mechanical (e.g., vibration) signal.

Embodiments of the system embrace the use of hardware, firmware, and/or software operating on the identifier device, the observing device, or on one or more remote computing resources (e.g., a cloud server) for managing, monitoring, and/or alerting entry point access. Some embodiments accordingly involve use of an application operating on the observing device and at least intermittently (on a schedule permitting timely response to unauthorized entry point activation) communicatively coupled to the identifier device (sensor) using a wireless technology, such as Bluetooth.

In certain embodiments, any number of identifier devices may be associated with a single observing device within the selected proximity range of the observing device. The identifier devices of some embodiments are kept relatively simple, with a body that is affixable to or may be incorporated into a moveable portion of an entry point structure (such as a door, window pane, cabinet door, drawer, lid, curtain, and the like). The body houses (and/or is otherwise associated with) a wireless transceiver (e.g., Bluetooth chip), a processor (e.g., an inexpensive processor), embedded software, a power supply (e.g., a battery or other portable current source), and/or a multi-axis motion sensor, all packaged within (and/or otherwise associated with) a suitable shape or form.

The observing (or monitoring) device can report status changes of its connected identifier (or sensor) devices as status changes occur, or can accumulate changes and provide a status report on demand of the user. Furthermore, the user can request a current status of the entry points, and the system can provide a current status based on the last-updated position of each identifier device or of the entry point structure(s) to which the identifier device(s) are attached.

Figure 3:
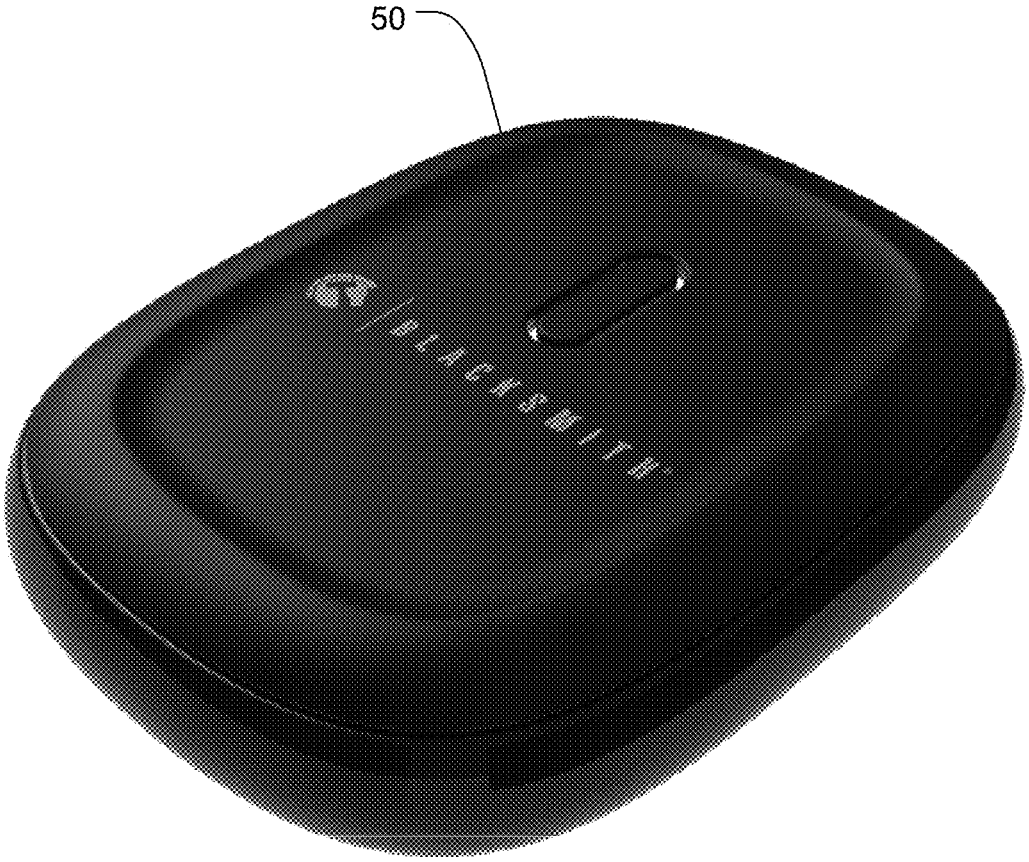
FIG. 3 shows a perspective view of a representative embodiment of an entry point sensor.

FIG. 3 illustrates a representative embodiment of an entry point sensor 50, which is one example of an embodiment of an identifier (or sensor) device or of a multi-axis position sensor. The entry point sensor 50 may have any desirable shape, color, or dimensions, so the particular shape, color, and dimensions of the entry point sensor 50 illustrated in FIG. 3 are intended to be illustrative only, and are not intended to be limiting of the variety of visual features of the various embodiments of the entry point sensor 50. The visual features of the embodiments of the entry point sensor 50 may be varied for aesthetic and/or functional purposes without departing from the scope of the present invention, as defined in the claim set appended hereto.

Figure 4:
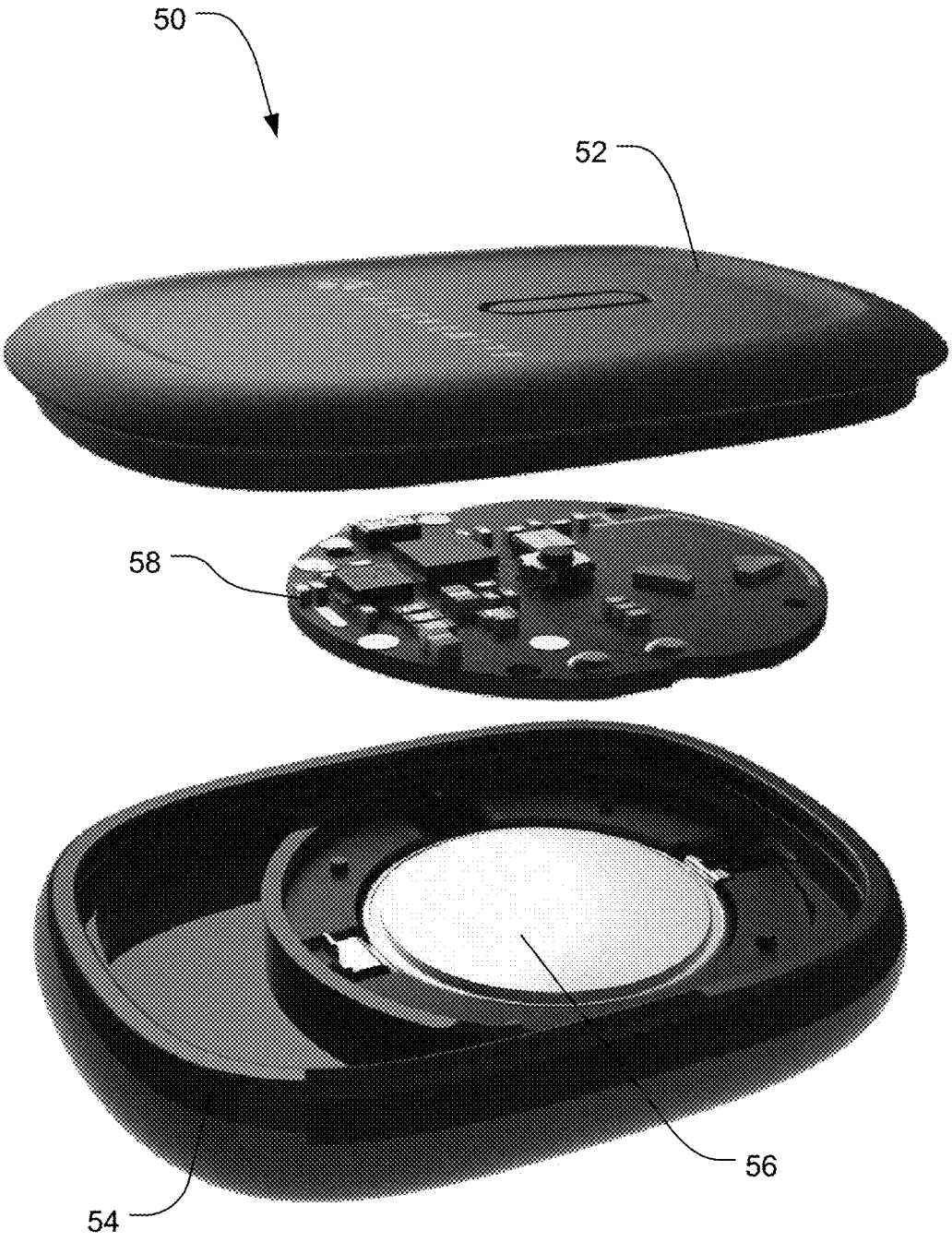
FIG. 4 shows a perspective exploded view of the entry point sensor of FIG. 3.

An embodiment of the entry point sensor 50 of FIG. 3 is shown in exploded form in FIG. 4. Indeed, FIG. 3 shows that, in some embodiments, the entry point sensor 50 includes a body formed as an anterior body part 52 and a posterior body part 54. The anterior body part 52 and the posterior body part 54 are (in some cases) user-separable to provide access to the internal components housed within the body, which may include a user-replaceable battery 56 as well as a component board 58. In this regard, the component board 58 may include any suitable electrical and/or electromechanical components, including as discussed herein, to provide the functions of the entry point sensor 50 discussed herein, such as a multi-axis motion sensor, processing, memory storage, wireless communications, and the like.

In accordance with some embodiments, the posterior body part 54 is affixed to a moveable structure of an entry point, such as a door in a door frame, a cabinet door, a moveable part of a window (pane or frame), a drawer, a lid, or any other similar structure. The posterior body part 54 may be so affixed using any desirable affixation method, such as using an adhesive, using a fixation fastener such as a screw or nail, using a suction cup (particularly when being affixed to smooth surfaces such as glass), or the like, by affixing a mating receiver to the moveable structure of the entry point where the mating receiver is adapted to receive and secure at least the posterior body part 54 (or potentially the whole body) therein to functionally affix the body to the moveable structure of the entry point, and/or in any other suitable manner. In other embodiments, the posterior body part 54 may be formed with or directly incorporated into the moveable structure of the entry point, such as by being molded into a door panel of a door. In still other embodiments, the posterior body part 54 may be formed with or directly incorporated into hardware mounted on the moveable structure of the entry point, such as a door handle, door lock, door sweep, hinge, decorative item, or peephole structure, such that affixing or otherwise incorporating such hardware into the moveable structure of the entry point effectively mounts the entry point sensor on the moveable structure of the entry point.

Regardless, when or how the entry point sensor 50 is affixed to the moveable structure of the entry point, the entry point sensor 50 is adapted to record rotating (e.g., hinged), linear (e.g. sliding), and/or any other suitable movement of the moveable structure of the entry point, such that the entry point sensor 50 can report to its associated observing device when motion is detected. Because the entry point sensors 50 can be small in size, they may be mounted in inconspicuous locations while still providing responsive security and convenience features not previously available.

Figure 5:
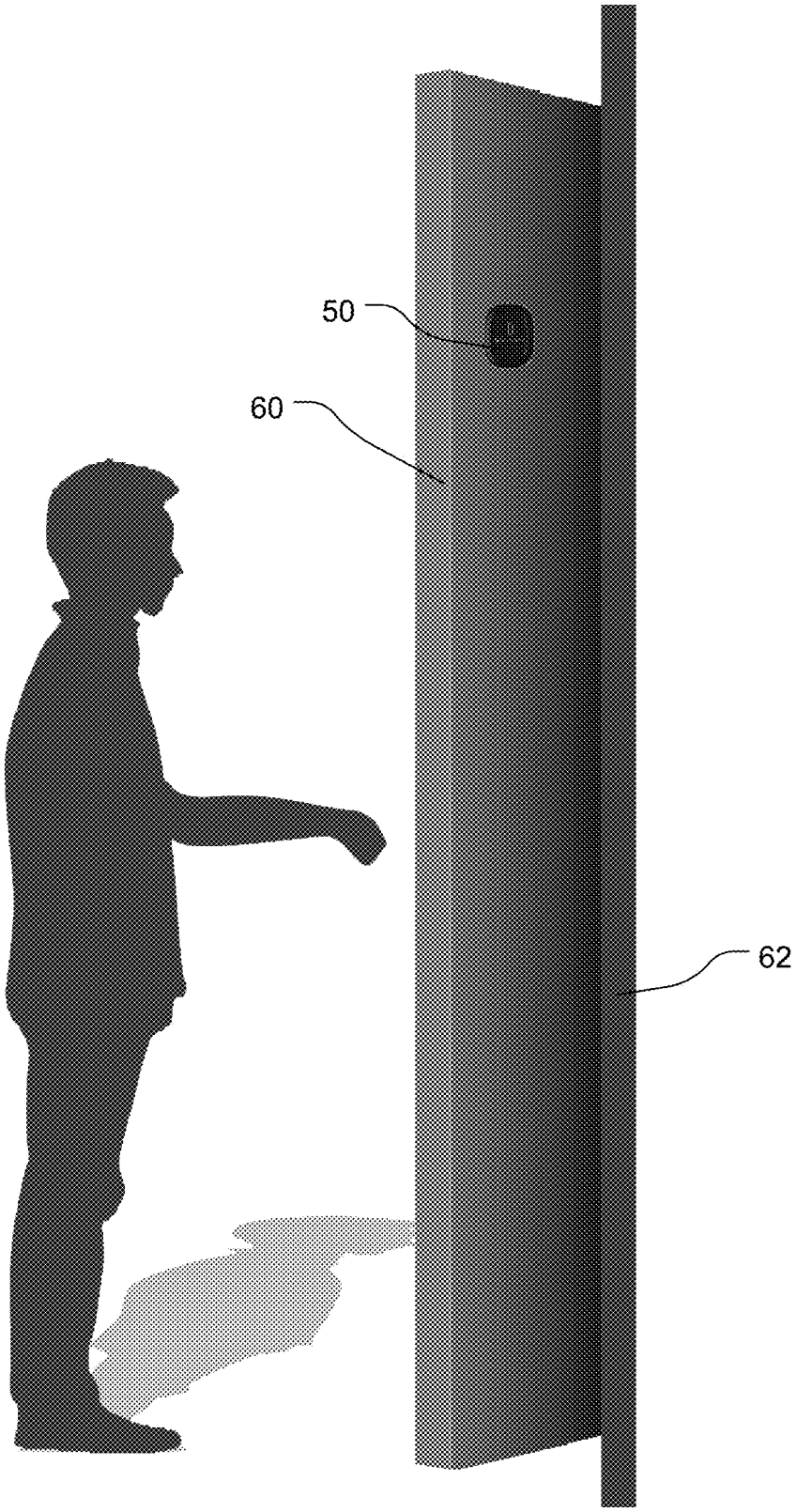
FIG. 5 shows a representative view of the entry point sensor of FIG. 3 mounted on an interior surface of a representative door.

FIG. 5 illustrates one manner in which the entry point sensor 50 may be affixed to a moveable portion of an entry point, in this case a door 60. The entry point sensor 50 may be affixed to an interior surface of the door 60 for aesthetic reasons, such as to maintain an uninterrupted outward appearance of the door, as well as for functional reasons, such as to not alert would-be intruders to the presence of the entry point sensor 50, to prevent vandals from damaging the entry point sensor 50, and the like. In some embodiments, the entry point sensor 50 is placed on the door 60 relatively far from the door's hinge, such that any movements of the door 60 are more readily detected by the entry point sensor 50. The entry point sensor 50 may also be placed high on the door, if desired for aesthetic or functional reasons, as discussed with respect to interior as opposed to exterior placement.

In contrast to some traditional entry point sensors, there is (in some embodiments) no portion of the entry point sensor 50 that needs to be affixed to the fixed, immovable portion of the entry point, e.g. a door frame 62. The single small entry point sensor 50 instead uses (in some embodiments) multi-axis motion sensing technology to reliably detect motion of the moveable portion of the entry point (the door 60), and in embodiments of the entry point sensor 50, to detect the position of the moveable portion of the entry point. The multi-axis motion sensing technology is incorporated into or affixed to the component board 58 and is powered by the battery 56 (and/or in any other suitable manner). In embodiments of the entry point sensor 50, power-saving features incorporated into the entry point sensor 50 ensure that the entry point sensor 50 functions for a significant length of time before needing servicing or recharging of the battery 56.

The multi-axis motion sensing technology may include a three-axis sensor, a six-axis sensor, a nine-axis sensor, and/or any other suitable sensor. In some embodiments, the three-axis sensor, the six-axis sensor, the nine-axis sensor, and/or other suitable sensor includes an electromechanical sensor. In some three-axis embodiments, the three-axis sensor comprises a three-axis accelerometer. In other three-axis embodiments, the three-axis sensor comprises a three-axis gyroscope. In further three-axis embodiments, the three-axis sensor comprises a three-axis compass.

In some six-axis embodiments, the six-axis sensor includes a three-axis accelerometer and a three-axis gyroscope. In other six-axis embodiments, the six-axis sensor includes a three-axis accelerometer and a three-axis compass. In still other six-axis embodiments, the six-axis sensor includes a three-axis gyroscope and a three-axis compass. In some nine-axis embodiments, the nine-axis sensor includes a three-axis accelerometer, a three-axis gyroscope, and a three-axis compass.

The three-, six-, nine-, and/or other suitable axis sensor allows some embodiments of the entry point sensor 50 to be used to detect motion of the moveable entry point structure to which the entry point sensor 50 is attached. In some embodiments, the three-axis, six-axis, nine-axis, and/or other suitable sensor allows the entry point sensor 50 to be used to detect an absolute (or near absolute) position of the moveable entry point structure to which the entry point sensor 50 is attached. By way of example, the three-axis compass may be used to monitor the orientation of the entry point sensor relative to the Earth's magnetic field, such that when the entry point sensor 50 is used on a hinged moveable entry point structure such as the door 60 illustrated in FIG. 5, the rotation of the door about the hinge can be determined by the orientation of the entry point sensor 50 within the Earth's magnetic field.

To facilitate determining position of the moveable entry point structure, a setup process may (in accordance with some embodiments) be followed after the entry point sensor 50 is affixed to the moveable entry point structure. Using an interface on the entry point sensor 50 (in some embodiments), on the observing device (in other embodiments), or a linked computing device such as a mobile device like a smartphone (in still other embodiments), the setup user may be directed to move the moveable entry point structure (e.g., the door 60) to various points within its range of motion, such as fully closed, fully open, and one or more intermediary partially-open points. At each point, the user is (in some cases) directed to hold the moveable entry point structure at that location while a reading is obtained from the entry point sensor 50 and stored by the system for future reference. The reading may be stored locally on non-volatile (and/or any other suitable) memory at the entry point sensor 50 (in some embodiments) or at the observing (or monitoring) device (in other embodiments) or at the user's computing device (in still other embodiments), and/or it may be stored remotely, such as at a system server contacted over a network (in further embodiments). The compass positional (and/or other suitable) information can then be used to later determine a status of the entry point (open, closed, partially-open, etc.), even if the entry point moveable structure is not then moving.

In an alternative setup procedure, the user may be directed to move the moveable entry point structure between certain points within its range of motion, potentially at one or more directed rates of motion, while readings are similarly obtained and stored. Such information can then be used in conjunction with later-sensed motions to determine, with a reasonable degree of certainty, the status of the entry point (e.g., open, closed, partially-open, etc.). Such a setup procedure may be used with both rotational motion (such as with respect to a hinged door) as well as linear motion (such as with respect to a sliding door, window, drawer, etc.) and/or with any other suitable form of motion (e.g., vibration and/or any other suitable form of motion).

Figure 6:
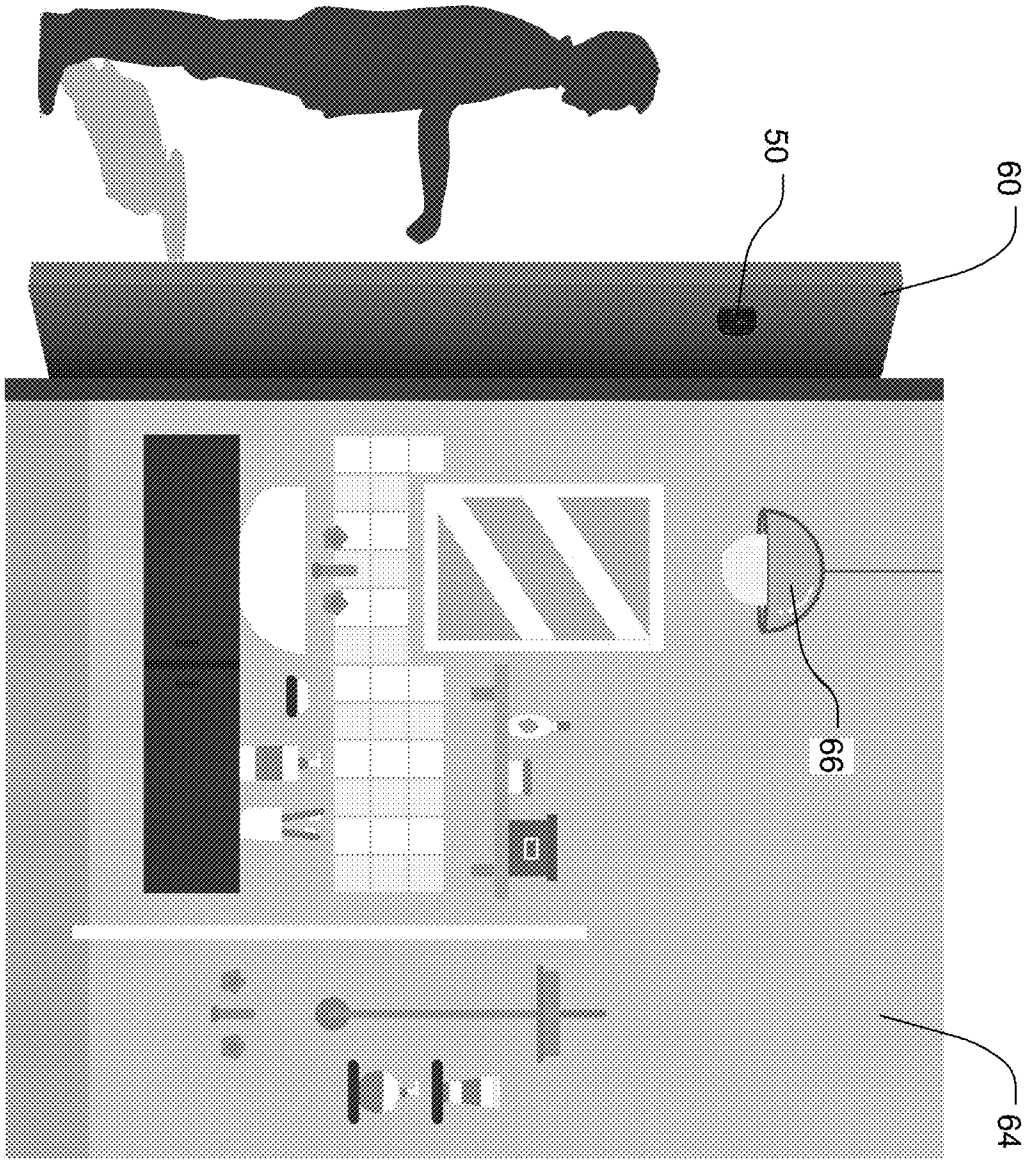
FIG. 6 shows a representative view of a room with a single entry point having the entry point sensor of FIG. 3 mounted thereon.

While embodiments of the entry point security system provide significant advantages with respect to providing entry point security, the advantages are not solely limited to this field of use. FIG. 6 illustrates a non-limiting alternate field of use. In this illustration, the entry point sensor 50 is affixed to the door 60 as in FIG. 5, but the door 60 is the sole entry point to a bathroom 64. In this illustration, as the user opens the door, the entry point sensor 50 detects motion and communicates with the observing device (not shown) to indicate that the bathroom is being opened. For safety and convenience, the observing device, which may be a standalone device in some embodiments or may be incorporated into (and/or in communication with) a smart device such as a lighting fixture 66 in other embodiments, causes the lighting fixture 66 to illuminate, thereby automatically lighting the room as the door 60 is opened or shortly thereafter. Accordingly, embodiments of the entry point sensor 50 may be used for safety and convenience purposes as well as for security purposes.

Figure 7:
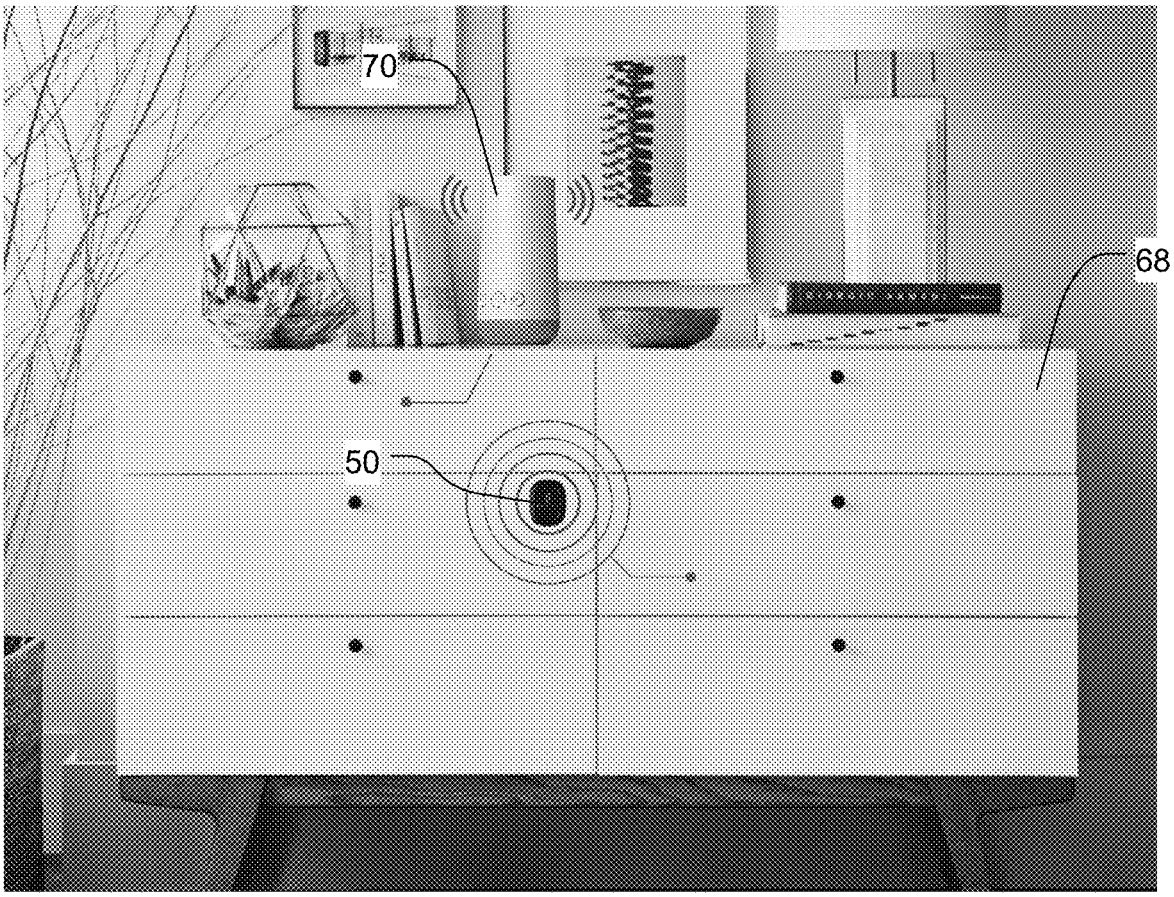
FIG. 7 shows a representative view of a chest of drawers with the entry point sensor of FIG. 3 mounted therein.

FIG. 7 illustrates a further use case. In this illustration, the entry point sensor 50 has been affixed to a drawer of a chest of drawers 68. As discussed previously, the entry point sensor 50 might typically be affixed to an interior surface of the drawer, but could be affixed to an exterior surface of the drawer. The entry point sensor 50 is within communicative range of one embodiment of the observing device, namely a hub 70. The entry point sensor 50 and the hub 70 may communicate wirelessly, such as using a Bluetooth connection in some embodiments, a Wi-Fi connection in other embodiments, a mesh network connection in other embodiments, or any other applicable connection. In some embodiments, the entry point sensor 50 and the hub 70 may be connected via a wired connection. Similarly, the hub 70 may be connected to a local or remote user computing device or to a remote server (whether provided by a service provider or controlled by the user) using any desirable wireless and/or wired connection.

The entry point sensor 50 affixed to the drawer may be set up using a setup procedure similar to those discussed previously. Then, with the operative connections between the entry point sensor 50, the hub 70, the user computing device (optionally), and/or the remote server (optionally), the drawer can be protected against unauthorized opening of which the user is unaware. If the drawer is locked, a first unsuccessful attempt to open the drawer may cause sufficient motion at the entry point sensor 50 to trigger an alert communication between the entry point sensor 50 and the hub 70. In some embodiments, the hub 70 can sound an alarm, flash lights or operate some other visual display, can vibrate, or can otherwise issue a notification that the drawer is being tampered with. In other embodiments, the hub 70 can generate a notification to that effect and can transmit it to the user's computing device or to the remote server, such that an applicable notification can be sent to the user and/or to any necessary authorities.

Figure 8:
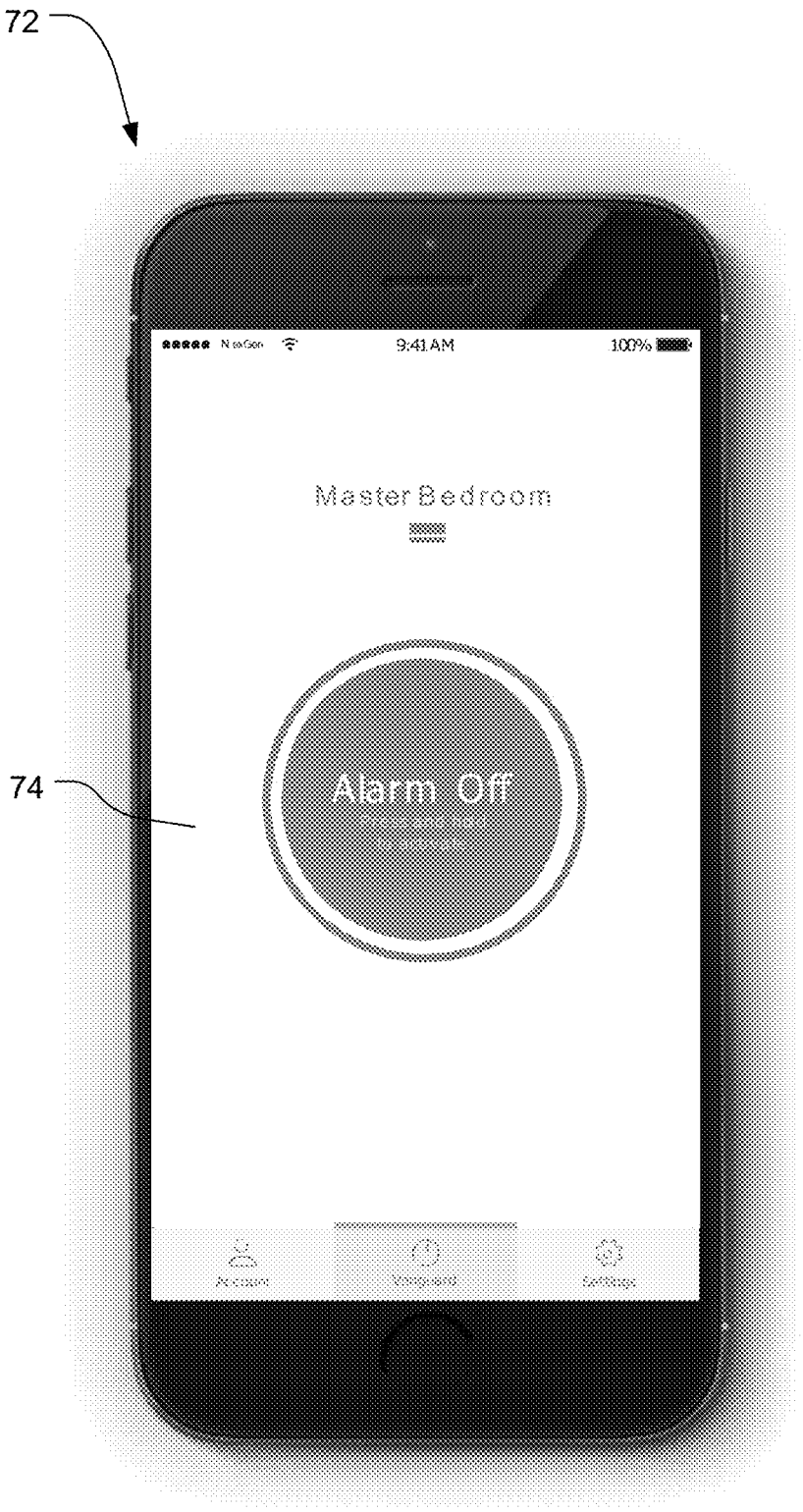
FIG. 8 shows a representative mobile device display in accordance with some embodiments of a notification system.
Figure 9:
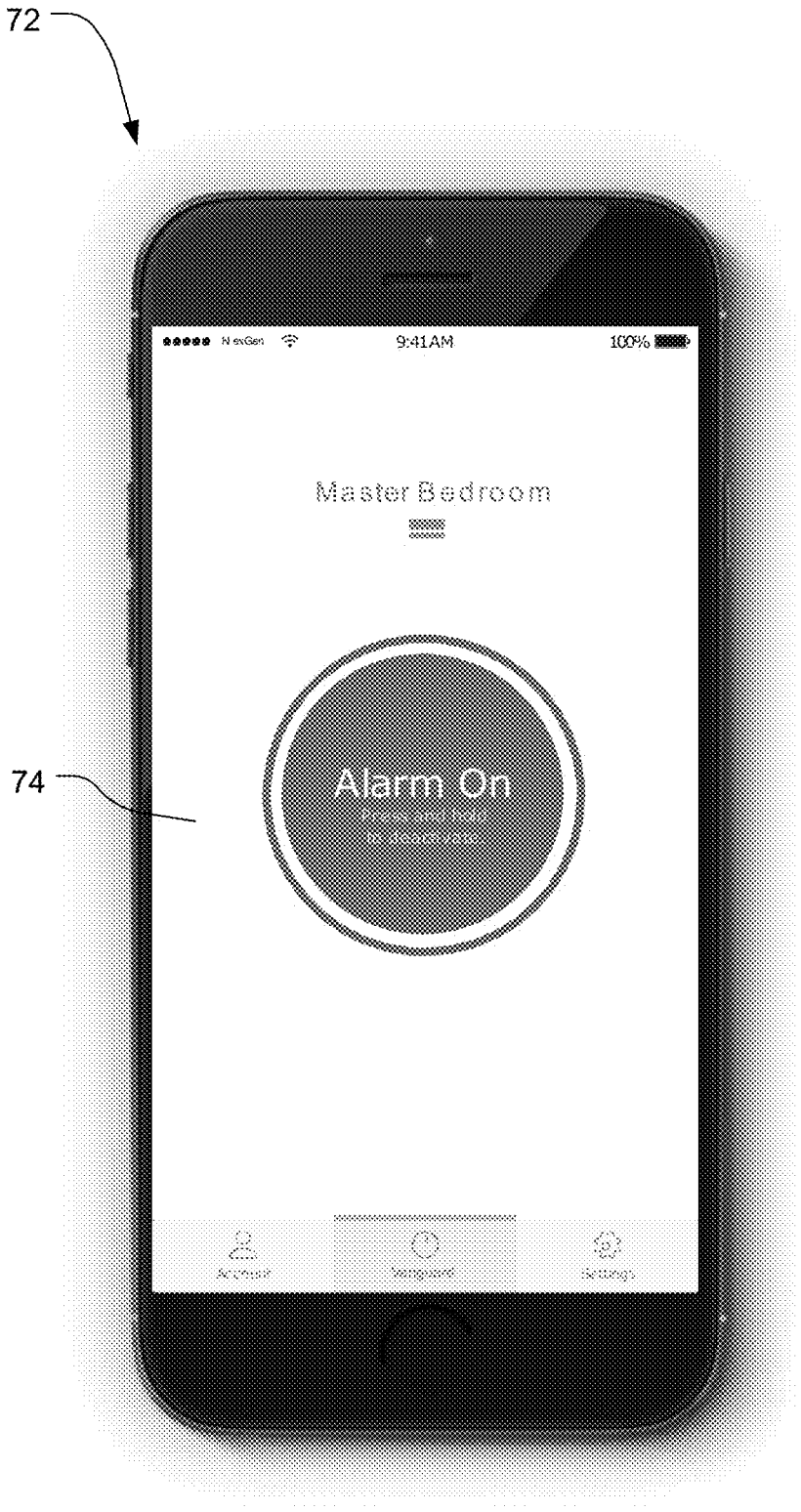
FIG. 9 shows a representative mobile device display in accordance with some embodiments of a notification system.
Figure 10:
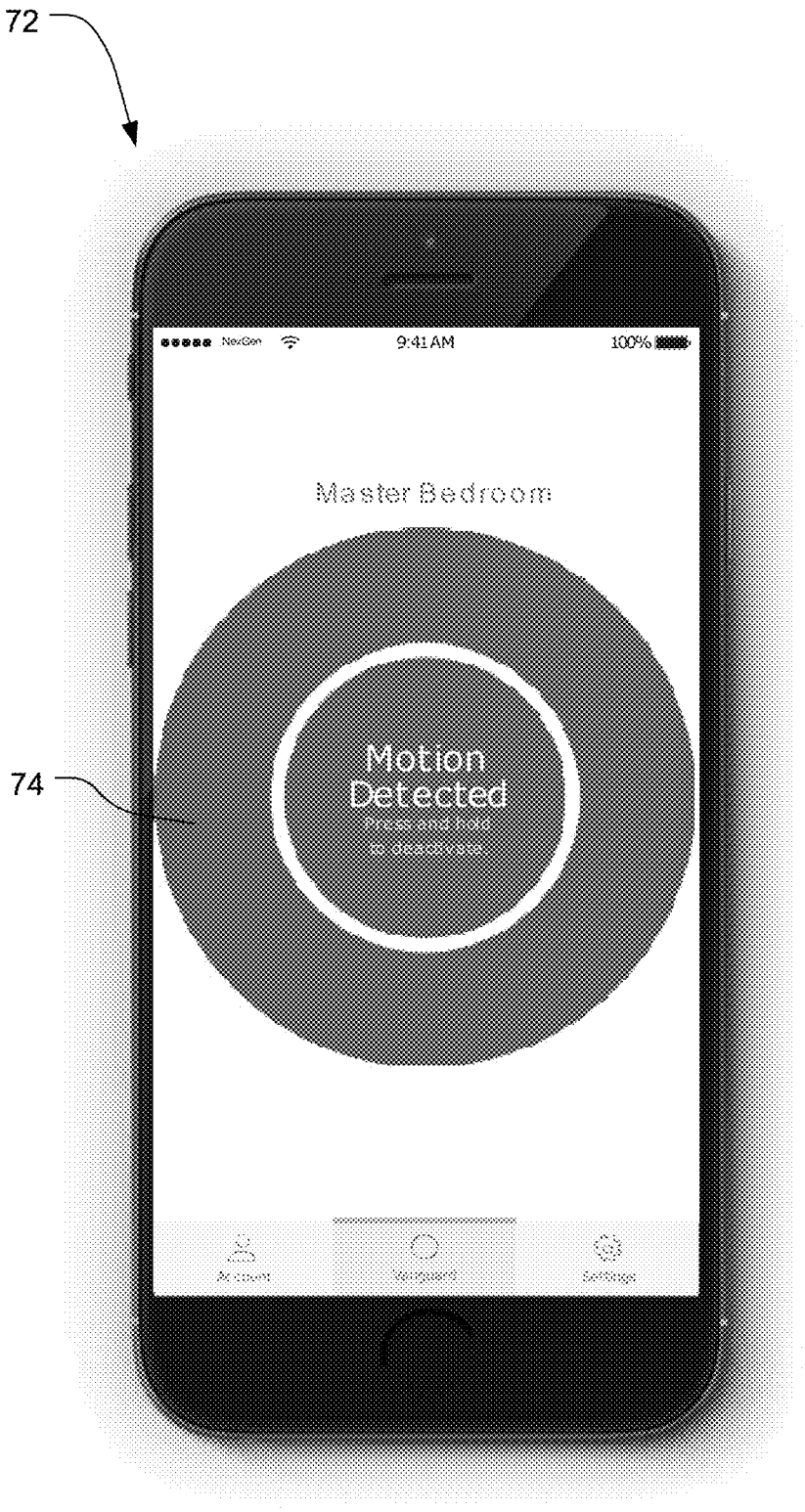
FIG. 10 shows a representative mobile device display in accordance with some embodiments of a notification system.

FIGS. 8-10 illustrate views of a user's mobile device 72, illustrating one embodiment of a user interface that may be used in some embodiments to present relevant notifications to the user. In the illustrated embodiment, the user might initially be shown a display on a screen 74 of the mobile device 72 such as that shown in FIG. 8. This display of FIG. 8 shows that the alarm is off. At an appropriate time, either locally (e.g., using a Wi-Fi, Bluetooth, or other wireless connection between the mobile device 72 and the hub 70) or remotely (using a cellular connection to a remote server in communicative connection with the hub 70), the user could take an action to activate the alarm, such as by holding down in the "Alarm Off" circle shown in FIG. 8 for an appropriate length of time (a few seconds in some embodiments).

Thereafter, the alarm system is instructed to be active and to provide protection and notification of unauthorized motion of the entry point sensors 50 (and thus the entry point moveable structures). Accordingly, the display shown on the screen 74 could be updated to that shown in FIG. 9 ("Alarm On"). At some point in time, if motion of one of the entry point sensors 50 was detected, the detected motion could be communicated through the hub 70, optionally (depending on the embodiment) to the remote server, and then to the mobile device 72. When such a notification is received, the screen 74 of the mobile device 72 could be updated to display a display such as is shown in FIG. 10 ("Motion Detected"). Accordingly, the user would be notified and could take some sort of remedial action.

In some embodiments, the remedial action could be taken through a security app operating on the mobile device. Accordingly, the display on the screen 74 of the mobile device could be updated with options to contact authorities, to notify the user's other contacts, to activate a siren or other audible alarm at the location of the disturbance, to disable the alarm or entry point sensor 50, and/or any other desirable action as set by the manufacturer or elected by the system user (e.g., during setup or otherwise). Thus, embodiments of the invention provide significant flexibility in handling detected motion events.

In some embodiments, detection of motion using the systems described herein can be used to trigger more-intense surveillance procedures, such as causing one or more video cameras to begin to operate. Accordingly, the manual and automatic responses to detected motion events can vary from situation to situation, based on a variety of factors.

In some embodiments, the observing or monitoring device (e.g., hub 70) need not be strictly in range of all the entry point sensors 50. Instead, one or more entry point sensors 50 may cooperate in a mesh network to extend the effective communication range of the observing device such that coverage of an entire area of interest can be received. Accordingly, some embodiments of the entry point sensors 50 are adapted to receive and pass on status communications from other entry point sensors 50.

Certain embodiments of the security system have been described herein. It is intended that all such embodiments be taken as being for descriptive purposes to facilitate understanding of the concepts surrounding the various embodiments of the invention. Accordingly, variations from the specific embodiments described herein should be encompassed within the scope of the invention as contained in the appended claims. By way of example, additional communicative devices could be included in a communicative chain between the entry point sensors 50 and the mobile device or other notification device used by the user to receive the notifications described herein. By way of another example, all notifications described herein could be received at the hub 70, which may provide a user interface approximating the experience illustrated with respect to FIGS. 8-10. Any number of variations could be similarly incorporated into various embodiments of the security system.

Information may be shared between the various components of the security system without the need to re-initiate trustworthiness procedures or other pairing procedures between the various system components after the initial setup procedure. Instead, the various components of the system may retain relevant encryption and link data to facilitate future connections, pairing, and sharing of data. In some embodiments, multiple users' systems may be adapted to share and forward information between them, such that if a communication link is lost between two components of one system, the information may still arrive via components of a neighboring system.

As another example, in addition to, or in place of, one or more multi-axis position sensors, the system includes any other suitable sensor, including, without limitation, one or more GPS sensors, vibration sensors, optical sensors, motion sensors, and/or any other suitable sensor that allows the system to identify movement of one or more entry point blocking structures.

As another example, the described sensor apparatus can be incorporated into virtually any suitable home security and/or home automation system, whether conventional or novel. In this regard, the sensor apparatus be used to identify movement of any suitable object that can carry the sensor apparatus, including, without limitation, one or more doors, drawers, cabinets, closet doors, pet doors, curtains, paintings, safes, and/or any other suitable object.

The present invention may be embodied in other specific forms without departing from its spirit or essential characteristics. Additionally, characteristics and components of various embodiments described herein can be combined in any suitable manner. Moreover, while components and characteristics described herein may be described in the singular form, the described systems and methods can comprise virtually any suitable number of any component described herein. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. An entry point security system comprising:

a multi-axis position sensor apparatus comprising:

a sensor body adapted to be affixed to an entry point blocking structure;

a sensor power supply contained within the sensor body;

a multi-axis motion detector contained within the sensor body and operatively connected to the sensor power supply;

a sensor communications wireless interface operatively connected to the sensor power supply and contained within the sensor body; and a sensor processor operatively connected to the multi-axis motion detector, the sensor communications interface, and the sensor power supply and contained within the sensor body, the processor being configured to detect motions of the sensor body from input received from the multi-axis motion detector and to transmit information regarding the motions of the sensor body using the sensor communications wireless interface; and a monitoring device at least intermittently communicatively coupled to the multi-axis position sensor apparatus, comprising:

a monitor power supply;

a monitor communications wireless interface operatively connected to the monitor power supply and at least intermittently communicatively coupled with the sensor communications interface;

a monitor processor operatively connected to the monitor power supply and the monitor communications interface and adapted to receive and process the information regarding the motions of the sensor body to generate notifications of entry status changes.

2. The entry point security system as recited in claim 1, wherein the entry point blocking structure comprises a structure selected from the group consisting of a hinged door, a sliding door, a window, a drawer, and a lid.

3. The entry point security system as recited in claim 1, wherein the monitoring device comprises a device selected from the group consisting of a dedicated entry point security hub, a desktop computing device, a laptop computing device, a tablet computing device, and a smart phone.

4. The entry point security system as recited in claim 1, wherein the system comprises a plurality of the multi-axis position sensor apparatuses as recited in claim 1, each sensor apparatus at least intermittently communicatively coupled to the monitoring device and each adapted to be affixed to a different entry point blocking structure.

5. The entry point security system as recited in claim 4, wherein at least one of the plurality of multi-axis position sensor apparatuses receives transmissions of information regarding motions of the body of another of the plurality of multi-axis position sensors and retransmits the information to the monitoring device.

6. The entry point security system as recited in claim 1, wherein the multi-axis motion detector comprises a detector selected from the group consisting of:

a three-axis sensor comprising a three-axis accelerometer;

a three-axis sensor comprising a three-axis compass;
a three-axis sensor comprising a three-axis gyroscope;
a six-axis sensor comprising a three axis gyroscope and a three axis compass;
a six-axis sensor comprising a three-axis accelerometer and a three-axis gyroscope;
a six-axis sensor comprising a three-axis accelerometer and a three-axis compass; and
a nine-axis sensor comprising a three-axis accelerometer, a three-axis gyroscope, and a three-axis compass.

7. The entry point security system as recited in claim 1, wherein the sensor communications wireless interface and the monitor communications wireless interface each comprises an interface selected from the group consisting of a Bluetooth wireless interface, an IEEE 802.11 (Wi-Fi) wireless interface, a wireless mesh network interface, and a cellular network interface.

8. The entry point security system as recited in claim 1, wherein the monitoring device is configured to convey the notifications of entry status changes to a user of the entry point security system through an action selected from the group consisting of:
displaying visual notifications on a screen of the monitoring device;
playing audio notifications on a sound transducer of the monitoring device;
generating vibratory notifications of a vibrator of the monitoring device;
generating and transmitting notifications through a computer network to a remote computing device;
modifying a state of an external device capable of generating an audio or visual cue; and
any combination thereof.

9. The entry point security system as recited in claim 1, wherein the information regarding the motions of the sensor body comprises information selected from the group consisting of:
transient accelerometer readings;
transient gyroscope readings;
transient compass readings;
changed but non-transient compass readings; and
any combination thereof.

10. The entry point security system as recited in claim 1, wherein the sensor body is affixed to the entry point blocking structure by a fixation selected from the group consisting of:
an adhesive material disposed between the sensor body and the entry point blocking structure;
a suction cup;
a fastener extending between the sensor body and the entry point blocking structure;
a body mating structure incorporated into the sensor body and adapted to mate to an entry point mating structure incorporated into the entry point blocking structure;
incorporation of the sensor body into a locking structure of the entry point blocking structure;
incorporation of the sensor body into an operating structure of the entry point blocking structure; and
an incorporation of at least a portion of the sensor body into the entry point blocking structure.

11. The entry point security system as recited in claim 1, wherein the system further comprises a non-volatile memory store, and wherein the system is configured to include a programming function wherein programming information from the multi-axis motion detector is obtained while the entry point blocking structure is in a plurality of positions, including at least a closed position and an open position and stored on the non-volatile memory store with information identifying corresponding positions of the entry point blocking structure, and wherein the system is configured to compare the information regarding the motions of the sensor body with the programming information to determine a state of the entry point blocking structure.

12. The entry point security system as recited in claim 11, wherein the non-volatile memory store is a memory store of a device selected from the group consisting of:
the monitoring device;
a local computing device at least intermittently communicatively coupled to the monitoring device, the local computing device being selected from the group consisting of a dedicated security hub, a local server, a desktop computing device, a laptop computing device, a tablet computing device, and a smart phone;
a remote computing device at least intermittently communicatively coupled to the monitoring device over a computer network, the remote computing device being selected from the group consisting of a remote dedicated security device, a remote server, a remote desktop computing device, a remote laptop computing device, a remote tablet computing device and a remote smart phone.

13. A method for providing entry point security comprising:
associating a multi-axis position sensor apparatus to an entry point blocking structure, the position sensor apparatus comprising a multi-axis motion detector;
communicatively coupling a monitoring device to the multi-axis position sensor apparatus;
detecting, at the multi-axis position sensor using the multi-axis motion detector, a movement of the entry point blocking structure;
receiving, at the monitoring device, a transmission of information from the multi-axis position sensor indicative of the movement of the entry point blocking structure;
processing the information from the multi-axis position sensor to determine a status of the entry point blocking structure; and
generating a notification of the status of the entry point blocking structure.

14. The method as recited in claim 13, further comprising performing a setup procedure after the multi-axis position sensor apparatus is associated with the entry point blocking structure, the setup procedure comprising steps of:
positioning the entry point blocking structure at a plurality of positions including at least a fully closed position at which the entry point blocking structure prevents access to a location and an open position at which the entry point blocking structure permits access to the location;
at each of the plurality of positions, obtaining information regarding readings of the multi-axis motion detector from the multi-axis position sensor apparatus; and
storing the information regarding readings of the multi-axis motion detector to a non-volatile memory store for use in determining entry point blocking structure position by comparison between the stored information and later-obtained information.

15. The method as recited in claim 13, wherein the multi-axis motion detector comprises a detector selected from the group consisting of:
a three-axis sensor comprising a three-axis accelerometer;
a three-axis sensor comprising a three-axis compass;
a three-axis sensor comprising a three-axis gyroscope;

a six-axis sensor comprising a three axis gyroscope and a three axis compass;

a six-axis sensor comprising a three-axis accelerometer and a three-axis gyroscope;

a six-axis sensor comprising a three-axis accelerometer and a three-axis compass; and a nine-axis sensor comprising a three-axis accelerometer, a three-axis gyroscope, and a three-axis compass.

16. The method as recited in claim 13, wherein the transmission of information from the multi-axis position sensor is received via an interface selected from the group consisting of a wired interface, a Bluetooth wireless interface, an IEEE 802.11 (Wi-Fi) wireless interface, a wireless mesh network interface, and a cellular network interface.

17. The method as recited in claim 13, wherein the notification of the status of the entry point blocking structure is selected from the group consisting of:

visual notification on a screen of the monitoring device;

an audio notification on a sound transducer of the monitoring device;

a vibratory notification of a vibrator of the monitoring device;

a notification transmitted through a computer network to a remote computing device;

a modification of a state of a separate linked device capable of generating an audio or visual cue; and any combination thereof.

18. The method as recited in claim 13, wherein the movement of the entry point blocking structure is detected by a measurement comprising a changed measurement of a compass of the multi-axis position sensor apparatus.

19. An entry point security system comprising:

a multi-axis position sensor apparatus comprising:

a sensor body adapted to be affixed to an entry point blocking structure;

a sensor power supply contained within the sensor body;

a multi-axis motion detector contained within the sensor body and operatively connected to the sensor power supply;

a sensor communications interface operatively connected to the sensor power supply and contained within the sensor body;

a non-volatile memory store contained within the sensor body; and a sensor processor operatively connected to the motion detector, the sensor communications interface, the non-volatile memory store, and the sensor power supply and contained within the sensor body, the sensor processor being configured to detect motions of the sensor body from input received from the motion detector, to include a programming function wherein programming information from the multi-axis motion detector is obtained while the entry point blocking structure is in a plurality of positions, including at least a closed position and an open position, and stored on the non-volatile memory store with information identifying corresponding positions of the entry point blocking structure, and wherein the sensor processor is configured to compare the information regarding the motions of the sensor body with the programming information to determine a state of the entry point blocking structure, and to transmit information regarding the state of the entry point blocking structure using the sensor communications interface; and a monitoring device at least intermittently communicatively coupled to the multi-axis position sensor apparatus, comprising:

a monitor power supply;

a monitor communications interface operatively connected to the monitor power supply and at least intermittently communicatively coupled with the sensor communications interface;

a monitor processor operatively connected to the monitor power supply and the monitor communications interface and adapted to receive and process the information regarding the state of the entry point blocking structure to generate notifications of entry status changes.

* * * * *